US007896276B2

(12) United States Patent
Antensteiner et al.

(10) Patent No.: US 7,896,276 B2
(45) Date of Patent: Mar. 1, 2011

(54) REFINER PLATES WITH HIGH-STRENGTH HIGH-PERFORMANCE BARS

(75) Inventors: Peter Antensteiner, Lewisburg, PA (US); Barry Hodge, Hughesville, PA (US)

(73) Assignee: Andritz Inc., Glens Falls, NY (US)

( * ) Notice: Subject to any disclaimer, the term of this patent is extended or adjusted under 35 U.S.C. 154(b) by 328 days.

(21) Appl. No.: 11/972,826

(22) Filed: Jan. 11, 2008

(65) Prior Publication Data

US 2008/0210795 A1 Sep. 4, 2008

Related U.S. Application Data

(60) Provisional application No. 60/887,972, filed on Feb. 2, 2007.

(51) Int. Cl.
*B02C 7/12* (2006.01)

(52) U.S. Cl. ..... 241/261.3; 241/296

(58) Field of Classification Search ..... 241/298, 241/261.3, 261.2, 297, 296
See application file for complete search history.

(56) References Cited

U.S. PATENT DOCUMENTS

| | | | | |
|---|---|---|---|---|
| 4,712,745 | A | 12/1987 | Leith | |
| 5,181,664 | A * | 1/1993 | Kohler | 241/261.3 |
| 5,467,931 | A * | 11/1995 | Dodd | 241/261.2 |
| 5,476,228 | A | 12/1995 | Underberg | |
| 5,893,525 | A | 4/1999 | Gingras | |
| 6,032,888 | A * | 3/2000 | Deuchars | 241/261.3 |
| 6,607,153 | B1 * | 8/2003 | Gingras | 241/261.3 |
| 6,957,785 | B2 * | 10/2005 | Virving | 241/166 |

FOREIGN PATENT DOCUMENTS

| | | |
|---|---|---|
| WO | 95/22653 | 8/1995 |
| WO | 95/24528 | 9/1995 |

* cited by examiner

*Primary Examiner* — Faye Francis
(74) *Attorney, Agent, or Firm* — Nixon & Vanderhye P.C.

(57) ABSTRACT

A refiner plate for mechanical refiner of lingocelluosic material, the refiner plate including: a refining surface including bars and grooves, wherein the bars each have an upper section including a leading edge and a lower section including a root at a substrate of the plate; the upper section of the bars has a narrow width and a draft angle less than five degrees, and the lower section of the bars has a wide width greater than the narrow width of upper section and a draft angle of at least five degrees on at least one sidewall of the bar.

20 Claims, 3 Drawing Sheets

REFINER PLATES WITH HIGH-STRENGTH HIGH-PERFORMANCE BARS

CROSS RELATED APPLICATION

This application claims the benefit of application Ser. No. 60/887,972, filed Feb. 2, 2007, which is incorporated in its entirety by reference.

BACKGROUND OF THE INVENTION

The present invention relates to refining discs and plate segments for refining discs, and more particularly to the shape of the bars and grooves that define the refining elements of the discs or segments. The plate segments may be used, for example, in refining machines for disperging, deflaking, and for refining all ranges of consistency (HiCo, LoCo and MC) of lignocellulosic material. Further, the invention may be applied to various refiner geometries, such as disc refiners, conical refiners, double disc refiners, double conical refiners, cylindrical refiners, and double cylindrical refiners.

Lignocellulosic material, such as wood chips, saw dust and other wood or plant fibrous material, is refined by mechanical refiners that separate fibers from the network of fibers that form the material. Disc refiners for lignocellulosic material are fitted with refining discs or disc segments that are arranged to form a disc. The discs are also referred to as "plates." The refiner positions two opposing discs, such that one disc rotates relative to the other disc. The fibrous material to be refined flows through a center inlet of one of the discs and into a gap between the two refining discs. As one or both of the discs rotate, centrifugal forces move the material radially outward through the gap and out the radial periphery of the disc.

The opposing surfaces of the discs include annular sections having bars and grooves. The grooves provide passages through which material moves in a radial plane between the surfaces of the disc. The material also moves out of the radial plane from the grooves and over the bars. As the material moves over the bars, the material enters a refining gap between crossing bars of the opposing discs. The crossing of bars apply forces to the material in the refining gap that act to separate the fibers in the material and to cause plastic deformation in the walls of said fibers. The repeated application of forces in the refining gap refines the material into a pulp of separated and refined fibers.

As the leading edges of the bars cross, the material is "stapled" between the bars. Stapling refers to the forces applied by the leading faces and edges of opposite crossing bars to the fibrous material as the leading faces and edges overlap. As the bars cross on opposite discs cross, there is an instantaneous overlap between the leading faces of the crossing bars. This overlap forms an instantaneous crossing angle which has a vital influence on the material stapling and/or the covering capability of the leading edges of the bars.

FIG. 1 shows in cross-section a few bars 10 and grooves 12 of a conventional high performance low consistency refiner plate 14. These bars 10 typically feature a high bar height to bar width ratio and have a zero or nearly zero degree draft angle. The draft angle is the angle between the leading or trailing face (sidewall) 16 of a bar and a line 18 parallel to an axis of the plate. The refiner plate 14 may be formed of a single alloy, such as from the 17-4PH stainless steel alloy group. Refiner plates formed of the 17-4PH alloy tend to have a bar height to bar width ratios that are larger than refiner plates formed of other metal alloys. These large ratios result in narrow bars and sharp corners at the roots of the bars. Plates formed of the 17-4PH alloy tend to have high strength and bars that are not prone to failure.

The zero degree draft angle, narrow bars and deep grooves of conventional high performance plates may result in excessive and unsustainable stresses at the root 20 of the bars. Bar failure, e.g., shearing of bars at the root, may result, especially if the plate is formed of materials other than from the 17-4PH alloy group. Plates formed of the high strength 17-4PH alloy tend to have excessive wear and short operational lives when subjected to an abrasive refining environment. Refiner plates formed of alloys other than 17-4PH tend to have bar and groove pattern designs constrained by the brittleness of the utilized alloy material.

Because of excessive stresses on high and narrow bars, plates having conventional high performance bar and groove patterns may not be practically formed of high wear resistance stainless steel material. Stainless steel with good wear characteristics has been used to form less demanding refiner plate designs. But unsuccessful attempts have been made to develop alloys combining the toughness of the 17-4PH alloy with the wear resistance of other stainless steel alloys. Despite the efforts to find or develop suitable alloys, high performance refiner plate patterns keep break when formed of materials (other than 17-4PH) having inadequate energy absorption potential.

FIG. 2 is a cross-sectional diagram of another conventional high performance low consistency refiner plate 22. The cross-section shows the bars 24 and grooves 26 of the plate 22. The draft angle 28 is, for example, five (5) degrees which is considered a large draft angle. Large draft angles result in bars formed of greater amounts of material than bars with shallow draft angles, e.g., draft angles less than five degrees. The greater amount of material resides in the wide base of the bars.

The greater amount of bar material in bars with large draft angles increases the moment of inertia of the bars. The added bar material and greater inertia enhances the breakage resistance of the bars. The wide draft angle also lowers the applicable bar height to bar width ratio and thus leads to lower bar edge length potential. The consequences of lower bar height to width ratios and lower edge lengths are typically: lower energy efficiency, suboptimal fiber quality development, and a reduction in hydraulic capacity due to the non-linear reduction in open area in the grooves in the course of the plate's service life caused by large draft angles. Large draft angles also reduce the "sharpness" of the leading edges of the bars which may have a negative impact on the quality consistency over the service life of the plates.

There is a long felt need for high performance refiner plates and techniques to design plates that may be formed of a wide range of metal alloys, e.g., other than the 17-4PH alloy, that are now typically used to form conventional plates only. Further, there is a long felt need for refiner plates that provide both the refining characteristics typically found only with high performance refiner plates and have a long service life through enhanced wear resistance.

DETAILED DESCRIPTION OF THE INVENTION

A novel design technique has been developed for achieving refiner plates having bars with increased strength (such as typically found in high performance plates) and formed from high wear resistance materials. While the high wear resistance materials are commonly used in refiner plates, these features tend not to be present in conventional high performance plates formed of the 17-4PH alloy. The design techniques disclosed herein for high performance refiner plates is applicable to plates formed of alloys other than the 17-4PH alloy. By using the design techniques disclosed herein, refiner plates may be designed having high wear resistance and to be less prone to bar breakage than the conventional refiner plates described above.

The design technique treats the bars of a refiner plates as having an upper section and a lower section. The upper section of refining bars provides the refining action. The lower sections of the bars define the grooves that provide passages through which cellulosic material is transported between the refining plates. A design goal for the upper section of the bars is to provide high performance refining. A design goal for the lower sections of bars is to provide strength to the bar. The upper section of the bar should preferably mimic the bar design of high performance plates to achieve the performance of such plates, such as bars that are narrow and have zero or small draft angles. To achieve the design goal for the upper section, the region at the top and upper section of the bars may have narrow bar widths, shallow or zero draft angles and sharp upper edges, e.g. corners. To achieve the design goal for the lower region of the bars, the width of the bar may be increased, e.g., by wide draft angles and generous radii in corners at the bar roots, to avoid sharp corners at the roots of the bar. The lower section of the bars are preferably designed to provide sufficient resistance to bar breakage, such as by having rather wide thicknesses and generously curved roots at the substrate of the refiner plate.

Figure 3:
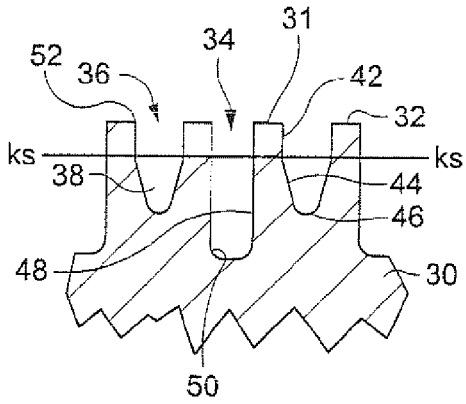
FIGS. 3 and 4 show, respectively, the inlets and outlets in cross-section of four bars and three grooves of a refiner plate design made using techniques in which goals for the upper section of the bars are distinct from those for the lower section of the bars.
Figure 4:
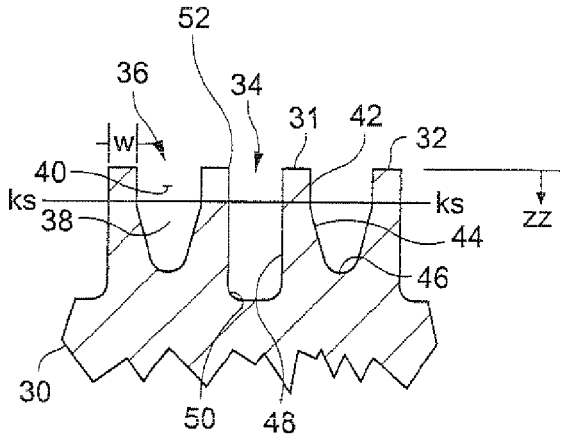

FIGS. 3 and 4 show, respectively, the inlets and outlets in cross-section of four bars and three grooves of a refiner plate 30 designed using the techniques in which the goals for the upper section of the bars are distinct from those for the lower section of the bars. The design goals for the upper and lower sections of the bars are stated above. The inlets to the bars 31, 32 and grooves 34, 36 shown in FIG. 3 are at a radially inward portion of a bar and groove section on a refiner plate. The outlet of the bar and grooves shown in FIG. 4 are at the radially outer portion of a bar and groove section. Each refiner plate may have one or more bar and groove sections arranged in concentric annular sections on the face of the plate. The bars 31, 32 may have similar cross-sectional shapes, and one bar 31 may be a mirror image of the other bar 37.

Each bar 31, 32 has two distinct sections which are: (i) an upper refining section 42 and (ii) a lower strength section 44. The upper section 42 of the bars is between the line KS at the upper end of the bars. The lower section 44 of the bars is below the line KS. The depth of the bar on one side (adjacent groove 34) is deeper than the depth of the bar on the opposite side, which is adjacent groove 36. The upper bar section 42 is generally similar for all bars and may be rectangular in cross-section. For example, the upper section of each bar is preferably narrow, has a small draft angle, e.g., one or two degree or less, and a sharp upper edge 52. The lower section 44 of each of the bars (below line KS) are relatively wide, especially at the root 50 (adjacent the deep grooves 34), have root corner radii, e.g., 0.030 inches or greater, and have a large draft angle, e.g., five degrees or greater, on at least on one side wall that is adjacent groove 36.

The lower sections 44 of the bars define grooves that are alternating wide shallow grooves 36 and narrow, deep grooves 34. The bars shown in FIGS. 3 and 4 have asymmetrical sidewalls below the transition (KS). Each bar includes a sidewall having a large draft angle that is opposite to a similar sidewall on an adjacent bar. Also, each bar has a sidewall with a small draft angle that is opposite to an adjacent bar with a similar sidewall. Adjacent bars may be mirror images of each other.

The following formulas show how the design goals and techniques described above are applied to limit stress at the bar roots of a refiner plate. The following equation may be used to calculate the relative stress applied to a bar over the height of the bar:

$$M := F \cdot zz \quad y := \frac{w}{2} \quad I := a \cdot \frac{w^3}{3}$$

$$\sigma := M \cdot \frac{y}{I} \quad \sigma = \frac{3}{2} \cdot F \cdot \frac{zz}{w^2 a}$$

Where M is a moment, e.g., torque, applied to a bar along a direction perpendicular to the bars vertical axis and parallel to the plate. The force (F) is treated for purposes of calculating stress on the bar as being applied to the upper edge of the bar, where the bar depth (zz) is zero. The moment (M) is a function of the force (treated as a constant) and the depth of the bar, where zz is zero at the top of the bar and maximum at the root of the bar. The parameter (y), is the middle of the bar, (along the depth of the bar) and is aligned with the bar axis. The parameter (w) is the width of the bar. The parameter I is the area moment of inertia (second moment of inertia) of the bar mass. The parameter σ is a bending stress applied to the bar by the force (F).

A comparison of standard and new bar design was made in terms of stress to prove the concept of the design goals. Two options for the bar shape were compared: (i) a regular bar shape with a 5 degree draft, and (ii) a bar shape (see FIGS. 3 and 4) having a small draft for the upper refining section of the bar (zz=0 to zs) and a substantial draft angle for the lower section of the bar (zz=zs to z(root)).

The following calculations show the viability of the bar and groove designs shown in FIGS. 3 and 4:

$$b := 1 \quad wo := b \quad z := 4 \cdot b \quad zs := 1.4 \cdot b$$

$$\theta 1 := 5 \cdot \frac{\pi}{180} \quad \theta 2 := 1 \cdot \frac{\pi}{180} \quad \theta 3 := 15 \cdot \frac{\pi}{180}$$

$$\sigma 1 := \frac{6 \cdot F \cdot z}{(wo + 2 \cdot z \cdot \tan(\theta 1))^2}$$

$$\sigma 2 := \frac{6 \cdot F \cdot zs}{(wo + 2 \cdot zs \cdot \tan(\theta 2))^2} \quad \ldots \text{is for } z < zs$$

$$wnew := wo + z \cdot \tan(\theta 2) + zs \cdot \tan(\theta 2) + (z - zs) \cdot \tan(\theta 3)$$

-continued $$\sigma 3 := \frac{6 \cdot F \cdot z}{(wnew)^2}$$

$$\frac{\sigma 3}{\sigma 1} \rightarrow \frac{1}{\left(6.2 + 5.4 \cdot \tan\left(\frac{1}{180} \cdot \pi\right) - 2.6 \cdot \sqrt{3}\right)^2} \cdot \left(1 + 8 \cdot \tan\left(\frac{1}{36} \cdot \pi\right)\right)^2$$

$$\frac{\sigma 2}{\sigma 1} \rightarrow \frac{.35000000000000000000}{\left(1 + 2.8 \cdot \tan\left(\frac{1}{180} \cdot \pi\right)\right)^2} \cdot \left(1 + 8 \cdot \tan\left(\frac{1}{36} \cdot \pi\right)\right)^2$$

$$\frac{\sigma 2}{\sigma 1} = 0.919 \quad \frac{\sigma 3}{\sigma 1} = 0.901$$

The parameter Wnew is used to determine the width (w) of a bar and in the above equation to determine Wnew, wherein the parameter wo is the bar width at the top of the bar. In addition, $\sigma_1$ represents the stress at the root in a conventional bar design (see FIG. 2); $\sigma_2$ represents the stress in the refining section of the bar design shown in FIGS. 3 and 4, and $\sigma_3$ represents the stress in the strength section of the bar design (described below) having constant stress along the depth of the bar (see discussion below). The above calculations yield ratios of the maximum stresses in the three types of blades. The ratios for σ2/σ1 and σ3/σ1 are less than one and, thus, show that the maximum stresses are equal to or lower for the bar designs shown in FIGS. 3 and 4, and the ideal bar cross-sectional shape than for a standard draft bar design.

An ideal bar shape is, for purposes of this discussion, a bar having a constant stress from the top to the root of the bar, or at least from the transition (KS) to the root. An ideal bar has a curved shape for the bar sidewall(s) that increases the width of the bars such that the stress in the bar remains constant for (zz>zs). The ideal bar shape may be defined by the following formulas.

$$zz := 1.4 \cdot b,\ 1.6 \cdot b \ldots 4.0 \cdot b$$

$$w(zz) := (wo + 2 \cdot zs \cdot \tan(\theta 2)) \cdot \begin{cases} 1 & \text{if } \frac{zz}{zs} < 1 \\ \sqrt{\frac{zz}{zs}} & \text{otherwise} \end{cases}$$

The above equation is one example of a means to determine a bar width for the lower section of an ideal bar where the stress in the bar remains constant along the depth (zz), or at least from ZS to the root of the bar. In the above example, ZS occurs at ZZ=1.4 b, where b is the width of the bar at the top of the bar. It is preferred that boundary (ZS average) on a bar between the upper section and the lower section be a distance from the top of the bar that is within 20 percent and preferably within five percent of 1.4 times the bar width. Due to manufacturing variations, particularly casting variations, the actual ZS at any specific point in a bar pattern may vary by substantially more than 20 percent. The average ZS is based on an average ZS for all bars in a refining section and after the bars have been machined following casting. Similarly, the bars shown in FIGS. 3 and 4 have a bar width (b) of 0.065 units at the top of the bar and KS is 0.091 units below the top of the bar, such that KS is 1.4 times b.

The stresses for all bar designs for a distance from the top of the bar in excess of zs can be calculated as follows:

$$\sigma 1(zz) := \frac{6F \cdot zz}{(wo + 2 \cdot zz\tan(\theta 1))^2}$$

$$\sigma 3(zz) := 6 \cdot \frac{F \cdot zz}{[wo + zz\tan(\theta 2) + zs \cdot \tan(\theta 2) + (zz - zs) \cdot \tan(\theta 3)]^2}$$

$$\sigma 5(zz) := 6 \cdot \frac{F \cdot zz}{\left[(wo + 2 \cdot zs \cdot \tan(\theta 2)) \cdot \sqrt{\frac{zz}{zs}}\right]^2}$$

Figure 5:
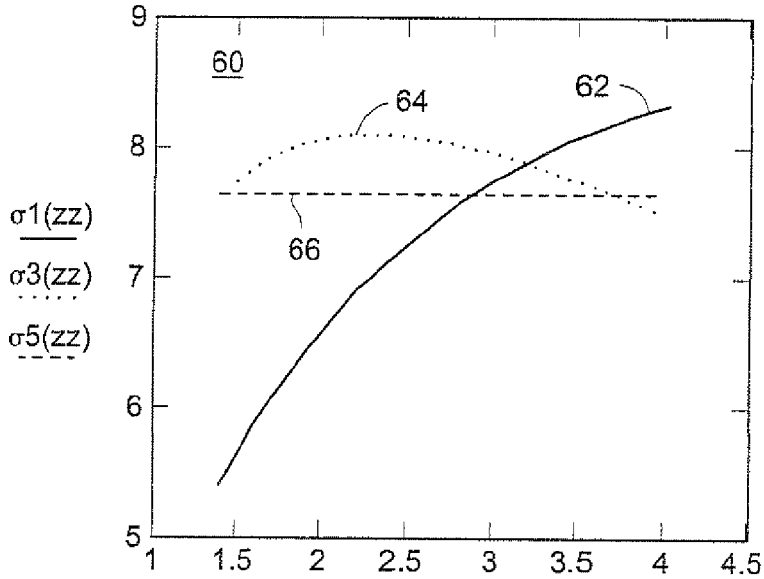
FIG. 5 is a chart graphing the stresses in a bar of a refiner plate along the depth for the bar designs discussed herein.

Setting all unknown constant factors to one, the relative stresses may be derived over the depth of the proposed bar designs, which are shown in the graph of FIG. 5.

Figure 1:
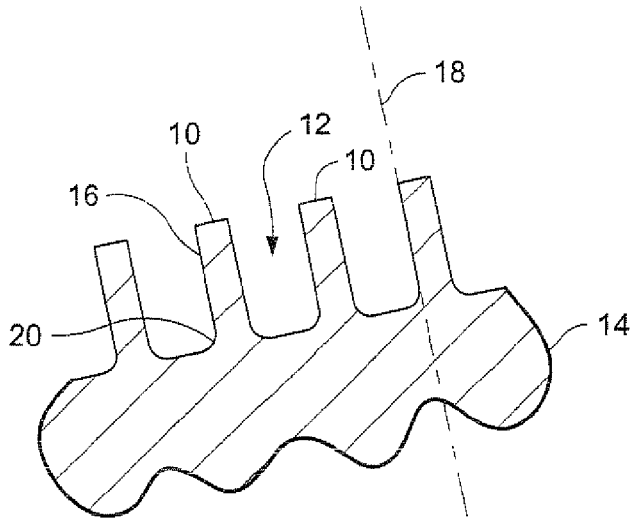
Figure 1 (Prior Art)
FIG. 1 is a cross-sectional diagram of a bars and grooves of a conventional high performance refiner plate.
Figure 2:
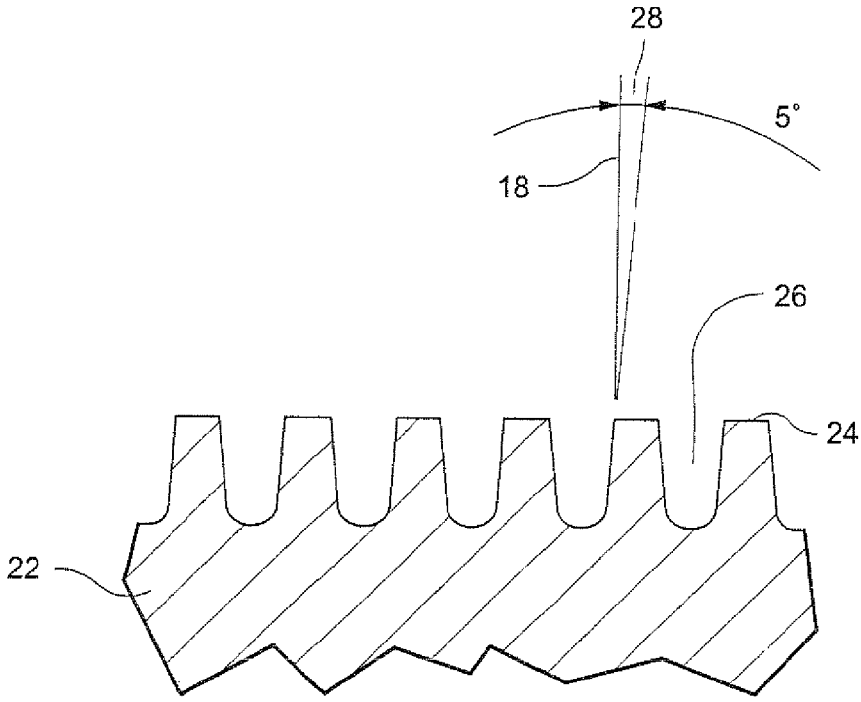
Figure 2 (Prior Art)
FIG. 2 is a cross-sectional diagram of a bars and grooves of a conventional refiner plate having a large draft angle on the bars.

FIG. 5 is a graph providing a comparison of the bar designs discussed above, which are $\sigma_1$ represents the stress in the bar along its depth (from zz 1.5 to 4, where zz is the ratio of depth of bar to bar width) in a conventional bar design (see FIG. 2); $\sigma_3$ represents the stress in a bar of a bar design shown in FIGS. 3 and 4, and $\sigma_5$ represents the stress in a bar of an ideal bar shape having constant stress along the depth of the bar. The stress for the ideal bar shape is a dashed line and is constant from KS to the root. The stress of the bar shown in FIGS. 3 and 4 is relatively uniform. The stress in a conventional bar is small near KS and increases exponentially towards the root (zz=4). Bars tend to fail at their root. The stress at the root for the ideal bar and the bars shown in FIGS. 3 and 4 is substantially less than the stress in the conventional bar $\sigma_1$.

The graph of FIG. 5 shows that the bars designed with the above goals and, in particular, with the lower section designed for strength and the upper section for refining performance, do not exceed the maximum stress of a standard bar design (σ1) while allowing a high performance refining section of the bar from zz=0 to zz=zs. The proposed bar designs combine the features of a high performance bar design with the features of a high wear resistance design and thereby allows the use of more brittle alloys.

The loss (Aloss in the equation below) in groove area can be determined as follows:

Lost Area:

$$Aloss := \left(z \cdot \tan(\theta 2) \cdot \frac{z}{2}\right) + \left(zs \cdot \tan(\theta 2) \cdot \frac{zs}{2}\right) + [(z - zs) \cdot zs \cdot \tan(\theta 2)] + \frac{(z - zs)}{2} \cdot zs \cdot \tan(\theta 3)$$

$$gwnarrow := b$$

$$Anew := gwnarrow \cdot b$$

$$\frac{Anew}{Aloss} = 1.413$$

By increasing the depth and width of deep, wide grooves, the area of all of the combined grooves can be adjusted to compensate for the wider lower section of bars and the alternating narrow, shallow grooves. In the example shown in FIGS. 3 and 4, the depth of the deep, wide grooves is increased to 0.325 units and the width of the groove is reduced to 0.109 units and the inlet and to 0.139 units at the outlet (the groove increases in width from inlet to outlet due to the increasing radius of the plate from inlet to outlet). The alternating grooves are wide and shallow, e.g., a depth (z) of 0.219 units at the inlet and 0.260 units at the outlet and a width (in the upper section) of 0.120 units at the inlet and 0.154 units at the outlet. The bar becomes relatively wide in the lower section of the wide, shallow groove to increase the bar strength. Below the bottom of the wide, shallow groove, the bar is supported on at least one side by the mass of the plate. The deep grooves may extend relatively far beyond the bottom depth of the wide, shallow groove to provide hydraulic capacity to the refiner plate.

Figure 6:
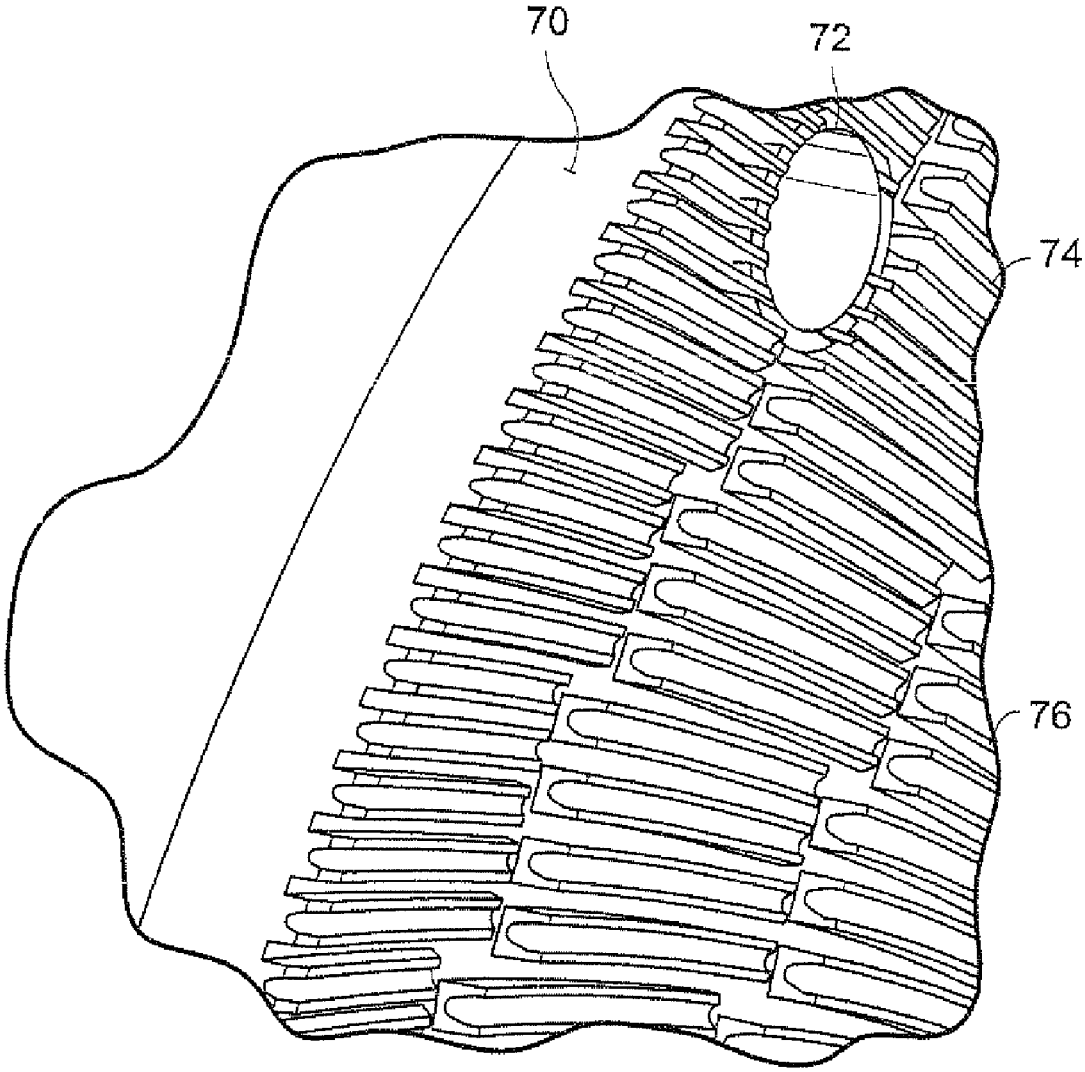
FIG. 6 is a perspective view of an exemplary refiner plate pattern that embodies the design goals and techniques illustrated in FIGS. 3 and 4.

FIG. 6 is a perspective view of an exemplary refiner plate 70 having patterns of bars and grooves that embodies the design goals and techniques disclosed herein. The refiner plate may be an annular metal plate or a pie-shaped metal plate portion that is assembled with other pie-shaped plate portions to form a complete annular plate. The refiner plate may be mounted on a disc of a conventional mechanical refiner. The patterns of bars and grooves are arranged in concentric annular refining sections 72, 74 and 76. In each of the annular sections, the groves alternate between deep grooves and shallow grooves. The deep grooves may be defined by the sidewalls of bars, i.e., a leading face of one bar and a trailing face of an adjacent bar, where the sidewalls have a small draft angle and the groove has a cross-section that is substantially rectangular. The shallow grooves may have a generally curved lower section resulting from the wide thicknesses of the adjacent bars. The shallow grooves from one annular section may be generally aligned with a shallow groove from a radially adjacent refining sections. Similarly, the deep grooves from one annular section may be generally aligned with the deep grooves of radially adjacent refining sections. Moreover, the deep grooves may be wider and deeper the grooves typically found in conventional high performance refiner plates. In widening the thickness of the lower section of bars, the open area is reduced in the grooves between the bars. This loss in open area potentially could reduce the hydraulic capacity of the grooves to pass pulp. However, the loss in open area resulting from widening the bars can be compensated for, at least in part, by having alternating shallow and deep grooves.

Refining feed material, e.g., wood chips and other lignocellulosic material, is processed by a refiner having a pair of opposing refiner plates mounted on discs, at least one of which discs rotates. The opposing surfaces of these plates have refining zones with grooves and bars, such as shown in FIG. 6. As the feed material moves between the opposing surfaces, the fibers are separated by the refining action that occurs in the refining sections. The material moves between the refining plates and through the concentric refining sections 76, 74 and 72, and is discharged from the radial periphery of the refining discs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner plate for mechanical refiner of lignocellulosic material, the refiner plate comprising:

a refining surface including bars and grooves, wherein the bars each have opposite sidewalls extending radially outward along the plate and the bars each include an upper section including an upper edge and a lower section including a root at a substrate of the plate;

the upper section of each of the bars has a narrow width between the sidewalls, and a draft angle with respect to the sidewalls in a range of greater than zero degrees and less than five degrees, and the lower section of the bars has a wide width greater than the narrow width of upper section and a draft angle of at least five degrees on at least one sidewall of the bar, wherein the draft angle extends along the sidewall of the lower section from the upper section to the root.

2. The refiner plate of claim 1 wherein the bars further include a boundary between the upper section and the lower section, wherein the boundary is a distance from an upper section of the bar to the boundary that is 1.2 to 1.6 times a width of the bar proximate to the leading edge of the bar.

3. The refiner plate of claim 1 wherein the grooves include shallow grooves and deep grooves alternating with the shallow grooves.

4. The refiner plate of claim 3 wherein the deep grooves have a substantially rectangular cross section.

5. The refiner plate of claim 1 wherein each of the bars have a first sidewall extending deeper into the plate than a second sidewall on an opposite side of the bar.

6. The refiner plate of claim 1 wherein the first sidewall has in the lower section with a draft angle of less than two degrees.

7. The refiner plate of claim 1 wherein the lower section includes a second sidewall having a draft angle of less than five degrees.

8. The refiner plate of claim 1 wherein the bar has opposite sidewalls, and the upper section of the bars have draft angles of less than one degree on both sidewalls, and the lower section of the bars has the draft angle of at least five degrees on a first of the sidewalls and a draft angle of less than two degrees on a second of the opposite sidewalls.

9. A refiner plate for mechanical refiner of lignocellulosic material, the refiner plate comprising:

a refining section including bars and grooves, wherein each of the bars has a first sidewall and second sidewall opposite to the first sidewall, wherein the first sidewall and the second sidewall extend radially outward along the plate, and each bar has an upper section including a leading edge and a lower section including a root at a substrate of the plate, wherein the upper section of each bar has a narrow width between the first sidewall and the second sidewall, and a draft angle in a range of greater than zero degrees and less than five degrees on each of the sidewalls, and the lower section of the bars has a width between the first sidewall and the second sidewall greater than the narrow width of upper section and a draft angle on a first of the sidewalls of at least five degrees and a draft angle of no greater than two degrees on a second of the sidewalls, wherein the first of the sidewalls of the lower section has the draft angle along substantially all of the surface of the first sidewall from the upper section to the root.

10. The refiner plate of claim 9 wherein the bars further include a boundary between the upper section and the lower section, wherein the boundary is a distance from an upper surface of the bar to the boundary that is 1.2 to 1.6 times a width of the bar proximate to the leading edge of the bar.

11. The refiner plate of claim 9 wherein the grooves include shallow grooves and deep grooves alternating with the shallow grooves.

12. The refiner plate of claim 11 wherein the deep grooves have a substantially rectangular cross section.

13. The refiner plate of claim 9 wherein the first sidewall extends deeper into the plate than the second sidewall on each bar.

14. The refiner plate of claim 9 wherein on a first type of the bars the first sidewall is a leading face of the first type and the second sidewall is a trailing face of the first type, and on a second type of the bars that are adjacent the first type of bars, the first sidewall is a trailing face of the second type and the second sidewall is a leading face of the second type.

15. The refiner plate of claim 14 wherein the bars of the refining sections alternate between the first type of bars and the second type of bars.

16. The refiner plate of claim 9 wherein the refining section is one of a plurality of refining concentric annular refining sections on the plate.

17. A refiner plate for mechanical refiner of lignocellulosic material, the refiner plate comprising:

a refining section including bars and grooves, wherein each of the bars has a first sidewall and second sidewall opposite to the first sidewall, wherein the first sidewall and second sidewall extend radially outward along the plate, and each bar has an upper section including a leading edge and a lower section including a root at a substrate of the plate, wherein the upper section of each bar has a narrow width between the first sidewall and the second sidewall, and a draft angle in a range of less than five degrees and greater than zero degrees on each of the sidewalls;

the lower section of the bars has a width greater than the narrow width of upper section and a draft angle on a first sidewall of the lower section of each bar of at least five degrees and a draft angle of no greater than two degrees on a second sidewall of the lower section, wherein in each bar the first sidewall is adjacent the first sidewall of a first adjacent bar and the second sidewall is adjacent the second sidewall of a second adjacent bar and wherein the draft angle on the first sidewall of the lower section extends substantially from the upper section to the substrate.

18. The refiner plate of claim 17 wherein the bars further include a boundary between the upper section and the lower section, wherein the boundary is a distance from an upper surface of the bar to the boundary in a range of 1.2 to 1.6 times a width of the bar proximate to the leading edge of the bar.

19. The refiner plate of claim 17 wherein the grooves include a shallow groove between the first sidewalls of adjacent bars and a deep groove adjacent the second sidewalls of adjacent bars.

20. The refiner plate of claim 19 wherein the deep groove is narrower than the shallow groove.

* * * * *